US006292146B1

(12) United States Patent
Melax

(10) Patent No.: US 6,292,146 B1
(45) Date of Patent: Sep. 18, 2001

(54) MULTI-POSITION PC CARD ANTENNA ASSEMBLY

(75) Inventor: Kenneth Melax, Calgary (CA)

(73) Assignee: Novatel Wireless, Inc., San Diego, CA (US)

( * ) Notice: Subject to any disclaimer, the term of this patent is extended or adjusted under 35 U.S.C. 154(b) by 0 days.

(21) Appl. No.: 09/588,588

(22) Filed: Jun. 5, 2000

(51) Int. Cl.[7] ..... H01Q 1/24

(52) U.S. Cl. ..... 343/702; 343/882; 343/901; 343/906

(58) Field of Search ..... 343/700 MS, 702, 343/715, 872, 880, 881, 882, 883, 900, 901, 906; H01Q 1/24, 3/02

(56) References Cited

U.S. PATENT DOCUMENTS 5,361,061 * 11/1994 Mays et al. ..... 340/825.44
5,568,364 * 10/1996 Madden ..... 361/752
5,646,635 * 7/1997 Cockson et al. ..... 343/702
5,779,496 * 7/1998 Bolinger et al. ..... 439/377
5,913,174 * 6/1999 Casarez et al. ..... 455/557

* cited by examiner

*Primary Examiner*—Tho G Phan
(74) *Attorney, Agent, or Firm*—Coudert Brothers

(57) ABSTRACT

A multi-position antenna assembly for use in portable wireless communication devices is disclosed. The assembly includes an antenna, a printed circuit board operative to electrically couple the antenna to a host device, a disk joint assembly, coupled to the antenna, operative to rotate the antenna about two axes of rotation, and an assembly housing which at least partially contains the printed circuit board and the disk joint assembly, and is adapted to be removably coupled to the host device. The disk joint assembly includes a joint housing having a projection piece which passes through the joint housing that enables the antenna to be positioned between alternating operating and storage positions within a PC card.

11 Claims, 5 Drawing Sheets

10
21
14
18
16
20
23
13
22
26
12
25

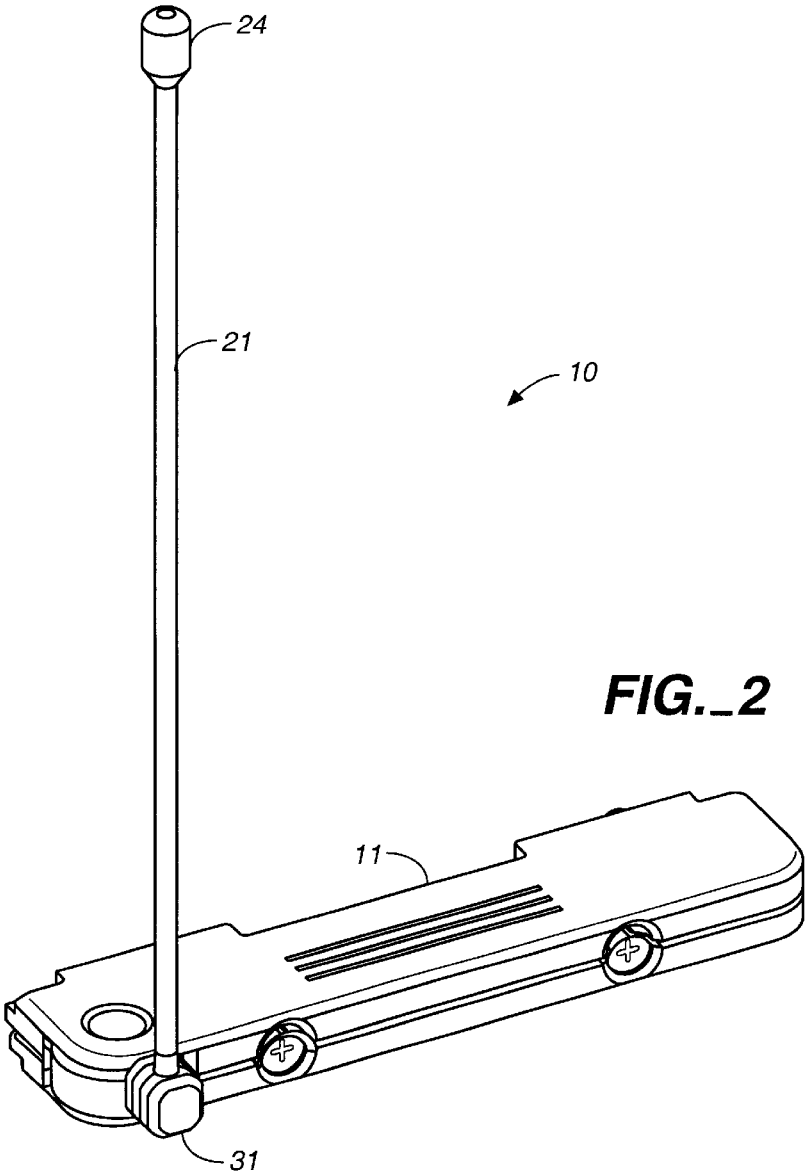
FIG._2
FIG._3
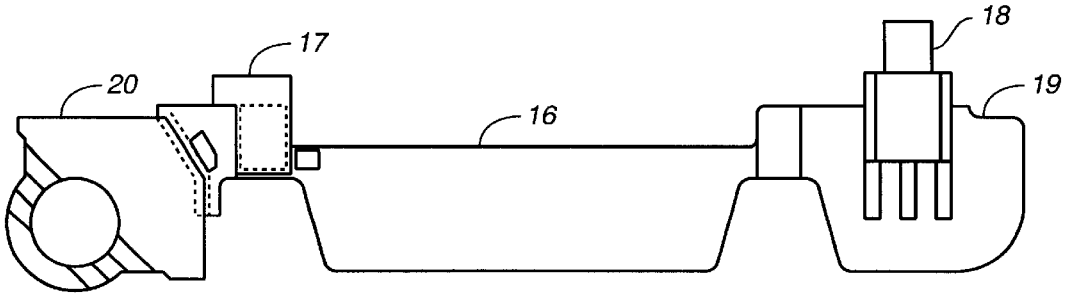

MULTI-POSITION PC CARD ANTENNA ASSEMBLY

FIELD OF THE INVENTION

The present invention generally relates to antennae for use in wireless communication products and, more particularly, to an antenna assembly for use in wireless communication products that is packaged within a personal computer (PC) card.

BACKGROUND OF THE INVENTION

PC cards are used in portable electronic devices such as, for example, laptop computers, palm top computers and personal digital assistants (PDA's) to add additional capabilities to such devices. A PC card which incorporates a radio may perform the dual operation of transmitting/receiving information from remote locations. For the radio to operate properly, an antenna is required to facilitate the transmission and reception of information.

In personal digital assistants and other portable electronic devices, the PC card is mounted within a card slot. Often times, this card slot is located on the side of the portable device. When a PC card with an antenna is inserted into the card slot, the antenna will protrude from the frame of the electronic device. To effectively transmit and receive information, the antenna must be placed in an extended position. While extended, the antenna may be struck by an object or a near by person. Striking the antenna may adversely affect the transmission/reception of information. Also, if the antenna is struck with enough force, damage to the antenna will result.

When the user is not transmitting or receiving information, the antenna and corresponding PC card are often removed from and stored outside of the portable electronic device. Thus, the user runs a risk of damaging the antenna by the continual insertion and removal of the PC card from the portable electronic device. Also, by constantly having to remove the PC card when not in use, the user runs the increased risk of losing the PC card.

Aside from being damaged during use or storage, or being lost, conventional antennas are also only capable of being rotated in one plane, or along a single axis. Thus, with conventional PC cards, the antenna will always protrude from the body of the portable device. In this fashion, damage to the antenna will almost certainly result.

SUMMARY OF THE INVENTION

The aforementioned and related drawbacks associated with conventional antennae and their corresponding assemblies are substantially reduced or eliminated by the multi-position PC card antenna assembly of the present invention. The multi-position antenna assembly of the present invention comprises an antenna; a printed circuit board operative to electrically couple the antenna to a host device; a disk joint assembly, coupled to the antenna, adapted to rotate the antenna along two axes of rotation; and an assembly housing which at least partially contains the printed circuit board and the disk joint assembly, and is adapted to be removably coupled to the host device. The antenna includes a radiating element and a base portion. An end cap is connected to the radiating element of the antenna. A whip base, having an opening formed therein, is connected to the base portion of the antenna.

The disk joint assembly comprises a joint housing having a female connector formed thereon operative to rotatably couple the antenna to the assembly housing through the use of a pivot bolt. The disk joint assembly also includes a projection piece extending through the joint housing for rotatably securing the joint assembly to the assembly housing. By coupling the disk joint assembly to the antenna and the assembly housing in such a fashion, the antenna can be rotated about two axes of rotation.

An advantage of the present invention is that it provides a compact, portable, full performance antenna for use in conjunction with portable electronic devices.

Another advantage of the present invention is that it provides an antenna having multiple degrees of freedom of movement.

Yet another advantage of the present invention is that the antenna may be rotated into a secure storage position.

Still another advantage of the present invention is that it provides an antenna having greater flexibility and durability than conventional antennas.

A feature of the present invention is that it is economical to manufacture.

BRIEF DESCRIPTION OF THE DRAWINGS

The aforementioned and related advantages and features of the present invention will become apparent upon reviewing the following detailed description of the invention, taken in conjunction with the following drawings, where like numerals represent like elements, in which:

FIG. 2 is a perspective view of the antenna assembly according to the present invention;

FIG. 3 is a schematic view of the printed circuit board used in the antenna assembly according to the present invention;

DETAILED DESCRIPTION OF THE INVENTION

Figure 1:
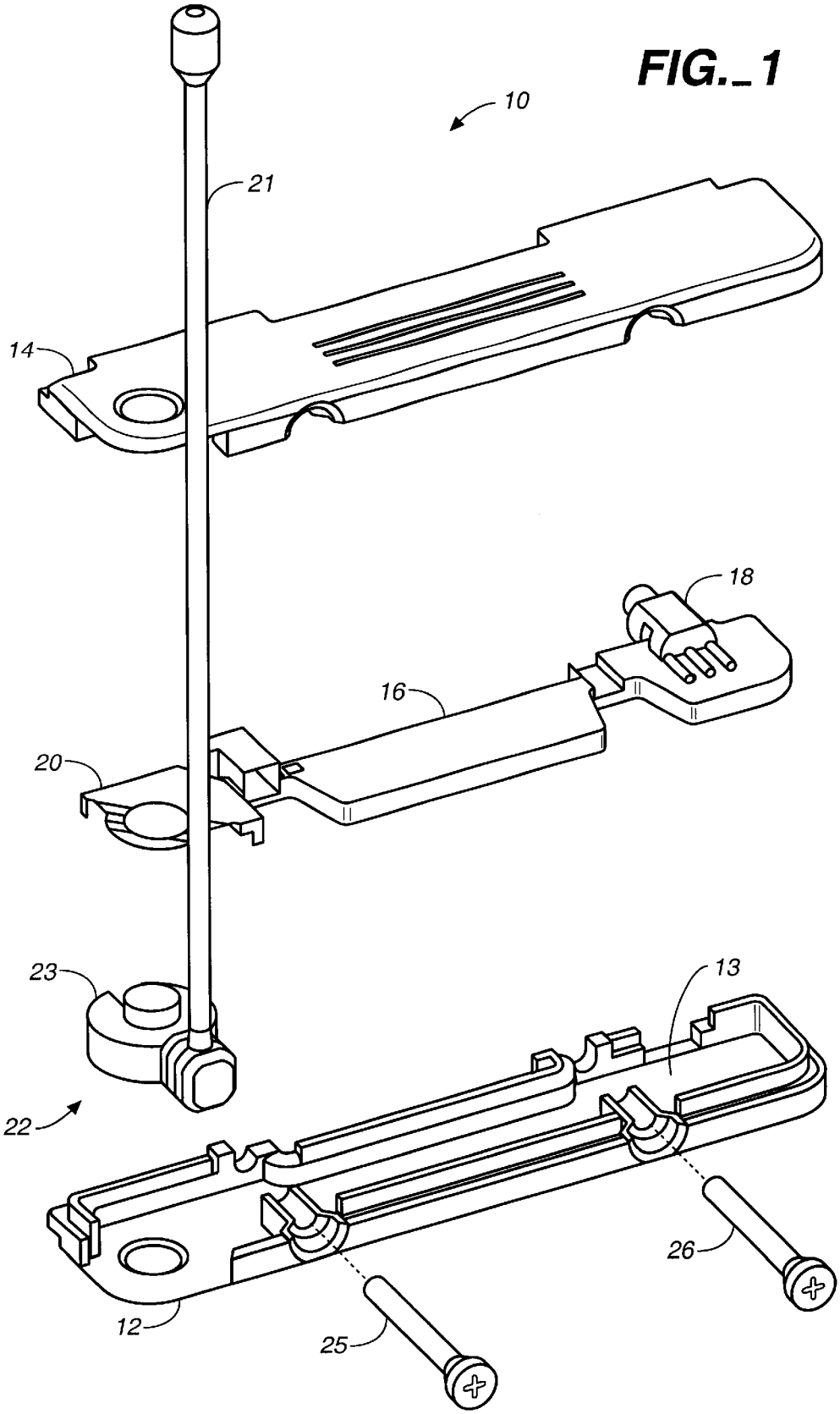
FIG. 1 is an exploded perspective view of the multi-position antenna assembly according to the present invention.

The multi-position PC card antenna assembly of the present invention will now be described with reference to FIGS. 1–6. As illustrated in FIGS. 1 and 2, the antenna assembly 10 includes a printed circuit board 16, an antenna 21, a disk joint assembly 22, and a housing 11 having a bottom portion 12 and a top portion 14. The bottom portion 12 of the housing has a lengthwise recess 13 formed therein, adapted to at least partially contain the printed circuit board 16. In an exemplary embodiment, the disk joint assembly 22 is placed within the recess 13 formed along one end of the bottom portion 12 of the assembly housing. The printed circuit board 16 is then placed within the lengthwise recess 13 located along the bottom portion 12 of the assembly housing. Next, the top portion of the housing 14 is placed over the printed circuit board 16. After the printed circuit board 16 has been sandwiched between the top portion 14 and the bottom portion 12 of the housing, the entire assembly is ultrasonically welded together. After welding, two screws 25, 26 are inserted into corresponding openings formed in the bottom portion 12 and top portion 14 of the housing to securely enclose the housing 11.

FIG. 3 is a schematic view of the printed circuit board 16 used in the antenna assembly according to the present invention. The printed circuit board 16 has a notch 19 formed at one end thereof to at least partially contain an RF connector 18. The RF connector 18 is electrically coupled to the RF circuit of a host device (not shown). Coupled to the opposite end of the printed circuit board 16 is an RF contact 20. The RF contact 20 electrically couples the antenna 21 to the printed circuit board 16. The printed circuit board 16 also includes a ground contact 17 which contacts the ground plane of the PC card of the host device (not shown). The printed circuit board 16 has traces formed thereon which provide for electrical interconnection between the components coupled thereto.

In operation, when information is being transmitted from the host device, the signal carrying the information is transferred from the RF circuit, through the RF connector 18, to the antenna 21. In corresponding fashion, when the host device is receiving transmitted information, the signal carrying such information is transferred from the antenna 21, through the RF connector 18, to the host device.

Figure 4:
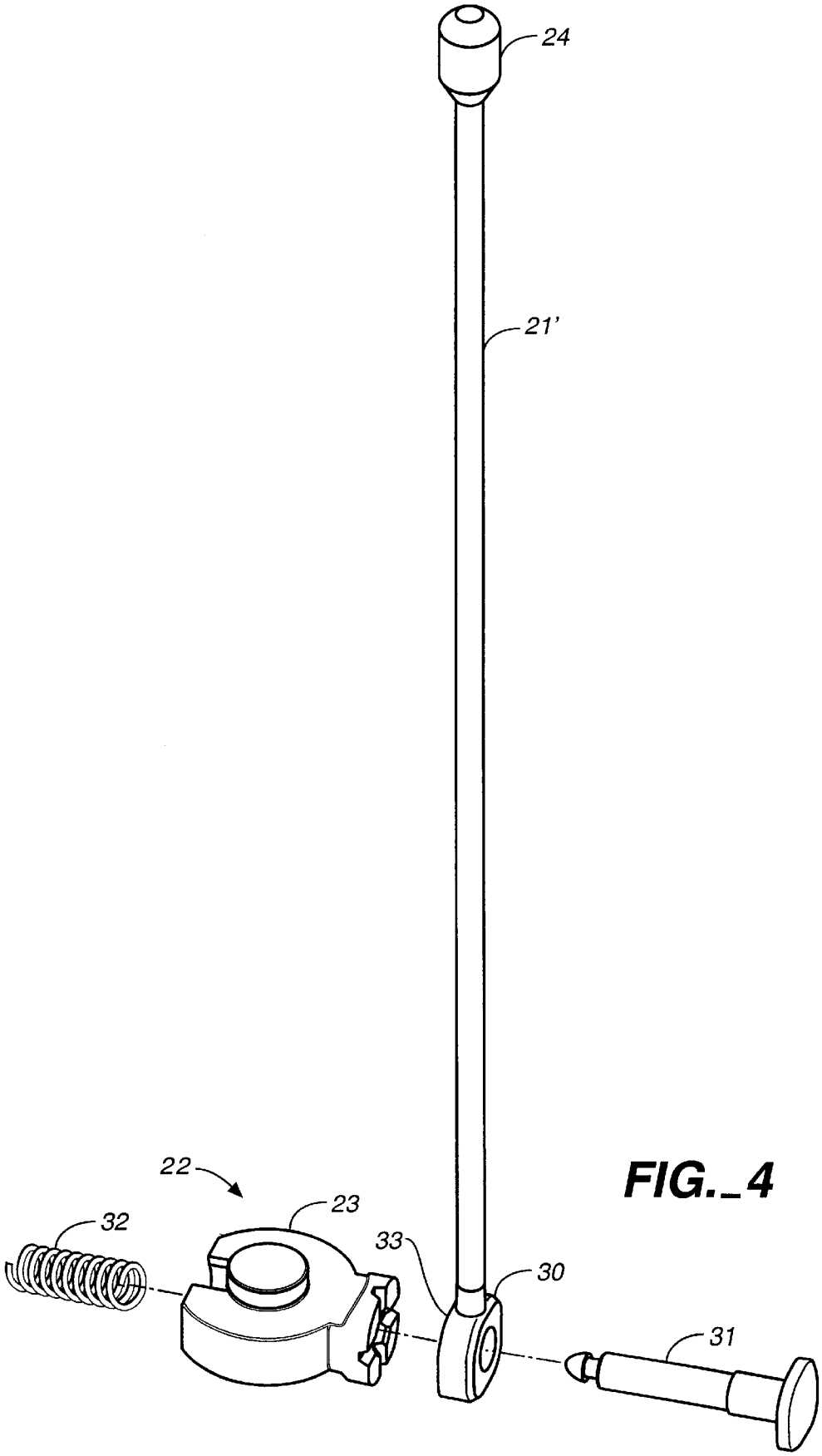
FIG. 4 is an exploded perspective view of the antenna and disk joint assembly according to the present invention.

FIG. 4 is an exploded perspective view of the antenna 21 and disk joint assembly 22 of the present invention. In an exemplary embodiment, the antenna 21 used in the assembly is a ¼-wavelength monopole antenna comprised of a radiating element 21' made from NiTi wire. The radiating element 21' has a length of about 77 mm. The radiating element 21' has an end portion and a base portion. An end cap 24 is connected to the end portion of the radiating element 21'. A base member 30, having an opening formed therethrough, is connected to the base portion of the radiating element 21'.

Figure 5A:
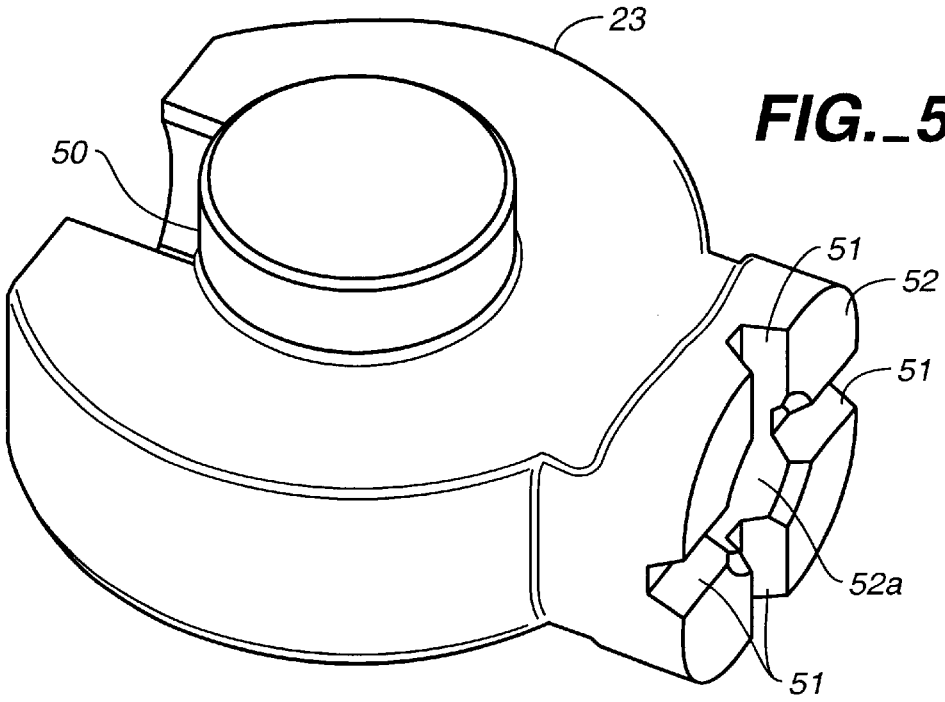
FIGS. 5*a*–5*b* are isometric views of the disk joint part employed to secure the antenna to the assembly housing according to the present invention.
Figure 5B:
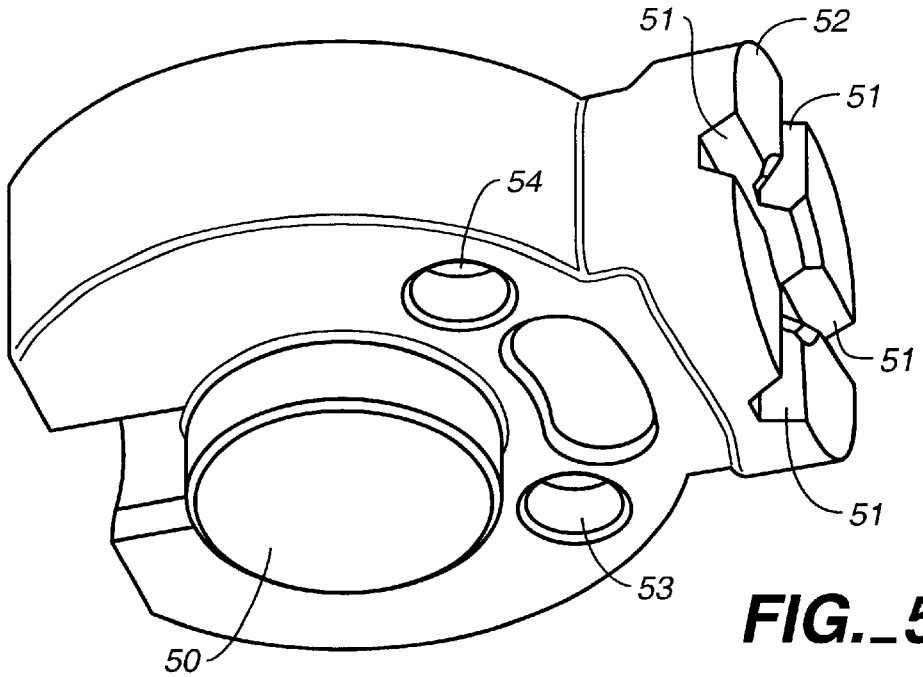

The antenna 21 is coupled via base member 30 to joint housing 23 of the disk joint assembly 22 through the use of a pivot bolt 31 which is passed through the base member 30 and the female connector 52*a* (FIG. 5) of the joint housing 23. A compression spring 32 is provided over the pivot bolt 31, within the body of the joint housing 23, to rotatably connect the antenna 21 to the joint housing 23. In a preferred embodiment of the present invention, as shown in FIGS. 5(*a*) and 5(*b*), base member 30 includes a tab member 33 which extends from the base member 30 and mates with a selected one of a plurality of corresponding grooves 51 formed in the joint housing. The tab member 33 and grooves 51 enable the position of the rotated antenna to be maintained in a selected direction. In a preferred embodiment, as shown in FIGS. 5(*a*) and 5(*b*), the antenna 21 can be selectively positioned in one of four directions as defined by the grooves 51 of the joint housing. In this fashion, the antenna 21 may be selectively rotated to positions 90° on a place perpendicular to the axis of rotation of the projection piece 50 of the joint housing 23.

As further shown in greater detail in FIGS. 5(*a*) and 5(*b*), the joint housing 23 includes a projection piece 50 formed through the housing. The projection piece 50 allows for rotation of the disk joint assembly 22 about a vertical axis of rotation. Formed along a circumferential edge of the joint housing 23 is an outwardly extending connector piece 52 having a female connector 52*a* formed therein, for mating with the pivot bolt 31 (FIG. 4) which is used to couple the antenna 21 to the joint housing 23. The female connector 52*a* also provides for the antenna 21 being rotated about a horizontal axis of rotation. Grooves 51 are provided at positions along the circumference of the female connector 52(*a*) to mate with the tab member 33 of the antenna 21 in order to maintain the antenna 21 at corresponding 90° angles. Indents 53, 54 are provided on the underside of the joint housing 23 for indexing the rotation of the disk joint assembly 22 relative to the bottom portion 12 of the antenna assembly housing 11. By connecting the disk joint assembly 22 to the antenna assembly housing 11 as discussed above, the antenna 21 can be translated along two axes of rotation.

Figure 6:
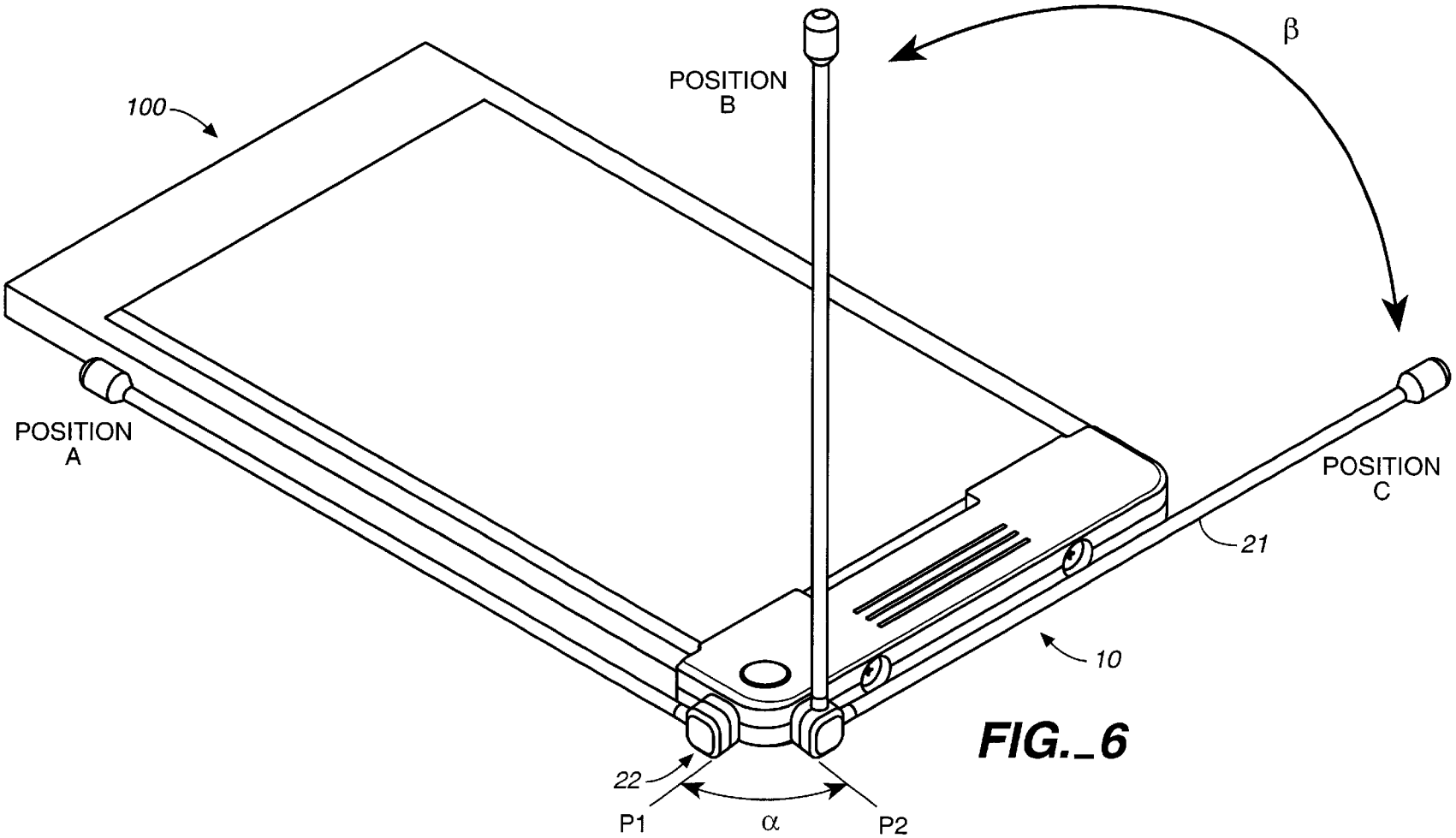
FIG. 6 is a perspective view of a PC card employing the multi position antenna assembly according to the present invention.

FIG. 6 is a perspective view of a PC card 100 employing the multi-position antenna assembly 10 of the present invention. In an exemplary embodiment, the PC card 100 has a form factor of 93 mm×54 mm×5 mm. As shown in FIG. 6, the antenna assembly 10 is coupled to a first end of the PC card. In operation, the antenna 21 is capable of being rotated about two axes of rotation through the use of the disk joint assembly of the present invention. The first axis of rotation is illustrated with respect to angle a which shows the antenna 21 being rotated along a vertical place from a storage position (Position A) to the operating position (Position B). The antenna 21 is maintained in the operating position by a tab member 33 mating with a corresponding groove 51 formed along the outer circumferential portion of the disk joint assembly 22.

The second axis of rotation is illustrated with respect to angle β which shows the disk joint assembly 22 being rotated along a horizontal place from a first position PI to a second position P2.

In a corresponding fashion, the disk joint assembly 22 of the present invention can be used to translate the antenna 21 from the operating position (Position B) to a second storage position (Position C) by first rotating the antenna 21 from Position A to Position B along angle α. Next, the disk joint assembly 22 is rotated from position P1 to position P2, along angle β. Then, the antenna 21 is rotated from Position B to Position C (as shown by the dashed lines). Thus, by employing the antenna assembly of the present invention, a ¼-wavelength monopole antenna can be used within the height limitations of, for example, a PCMCIA card.

In an alternate embodiment of the present invention, the antenna 21 may be a telescoping antenna. Thus, when the antenna is in a storage position, it can be compressed so as to be exactly flush against the PC card. Correspondingly, the antenna may be extended to its full length when placed in one of its operating positions.

The foregoing detailed description of the invention has been provided for the purposes of illustration and description. Although an exemplary embodiment of the present invention has been described in detail herein with reference to the accompanying drawings, it is to be understood that the invention is not limited to the precise embodiment disclosed, and that various changes and modifications to the invention are possible in light of the above teaching. Accordingly, the scope of the present invention is to be defined by the claims appended hereto.

What is claimed is:

1. An antenna assembly, comprising:

an antenna;

a printed circuit board operative to electrically couple the antenna to a host device;

a disk joint assembly, coupled to the antenna, operative to rotate the antenna along two axes of rotation; and an assembly housing which at least partially contains the printed circuit board and the disk joint assembly.

2. The antenna assembly of claim 1, wherein the printed circuit board further includes a connector operative to electrically couple the antenna to the host device.

3. The antenna assembly of claim 2, wherein the connector is an RF connector.

4. The antenna assembly of claim 1, wherein the antenna is a ¼ wave monopole antenna.

5. The antenna assembly of claim 4, wherein the antenna has a length of about 77 mm.

6. The antenna assembly of claim 1, wherein the disk joint assembly further comprises a joint housing; a projection piece extending through the joint housing, the projection piece being coupled to the assembly housing and operative to create one axis of rotation of the joint housing with respect to the assembly housing; and a female connector which rotatably engages the antenna.

7. The antenna assembly of claim 6, wherein the antenna is rotatably engaged to the joint housing by a pivot bolt and spring.

8. The antenna assembly of claim 6, wherein the joint housing has a plurality of grooves formed thereon operable to maintain the position of the antenna, and wherein said grooves are adapted to receive a tab member, wherein said tab member projects in a direction perpendicular to said axis of rotation of said joint housing.

9. The antenna assembly of claim 8, wherein the joint housing has four grooves formed thereon, the four grooves formed at 90° angles relative to one another.

10. The antenna assembly of claim 1, wherein the assembly housing further comprises a top portion and a bottom portion, the bottom portion having a cavity formed therein adapted to at least partially contain the printed circuit board.

11. The antenna assembly of claim 1, wherein said antenna is a telescoping antenna.

* * * * *

UNITED STATES PATENT AND TRADEMARK OFFICE

CERTIFICATE OF CORRECTION

PATENT NO. : 6,292,146 B1 
DATED : September 18, 2001
INVENTOR(S) : Kenneth Melax, Owen Thistle and Gordan Andrew May It is certified that error appears in the above-identified patent and that said Letters Patent is hereby corrected as shown below:

Column 1,
Line 15, delete “PDA’s”, substitute therefore -- PDAs --.

Column 3,
Line 36, after “to”, insert -- a --;
Line 39, “the female”, should read -- a female --;
Line 44, insert -- 4, --, before 5(a);
Line 54, delete “place”, substitute therefore -- plane --;
Line 54, “the projection” should read -- a projection --.

Column 4,
Line 18, delete “angle a”, substitute therefore -- angle [alpha sign] --;
Line 18, after “shows”, insert -- the disk joint assembly 22 being used to translate --;
Line 19, delete “being rotated along a vertical place”;
Line 19, “ a storage”, should read -- a first storage --;
Line 20, delete “the”, insert -- an --;
Line 20, after “(Position B)”, insert -- by first rotating the antenna 21 along a horizontal plane from P1 to P2 along angle [alpha sign]. The antenna 21 is then rotated along the second vertical axis of rotation illustrated by angle [beta sign] to the operating position, Position B. --;
Lines 25-28, delete all;
Line 32, after “by”, delete “first”;
Line 33, “Position A to Position B”, should read -- Position B to Position C --;
Line 33, delete “angle [alpha sign]”, insert -- angle [beta sign] --;
Lines 33-36, delete “Next, the disk joint assembly 22 is rotated from Position P1 to position P2, along angle [beta sign]. Then, the antenna 21 is rotated from Position B to Position C”;
Line 36, delete “dashed lines”, insert -- arrow --.

Signed and Sealed this

Twenty-seventh Day of August, 2002

*Attest:*

*Attesting Officer*

JAMES E. ROGAN
*Director of the United States Patent and Trademark Office*